US006210303B1

(12) United States Patent
Miller et al.

(10) Patent No.: US 6,210,303 B1
(45) Date of Patent: Apr. 3, 2001

(54) GOLF EXERCISE DEVICE

(76) Inventors: William J. Miller, 9 Meadowbrook Rd., Chester, NJ (US) 07930; Drew E. Siegel, 3 Ski Hill Dr., Bedminster, NJ (US) 07921

( * ) Notice: Subject to any disclaimer, the term of this patent is extended or adjusted under 35 U.S.C. 154(b) by 0 days.

(21) Appl. No.: 09/374,284

(22) Filed: Aug. 13, 1999

(51) Int. Cl.[7] ..... A63B 23/14
(52) U.S. Cl. ..... 482/45; 482/49
(58) Field of Search ..... 482/44–46, 49, 482/91, 140, 126, 114, 907, 82, 148, 124, 139, 129, 904; 473/212, 276, 266, 269, 219, 207, 284, 407, 408; 2/338, 311, 312, 248; 224/223, 918, 919; D21/692, 693

(56) References Cited

U.S. PATENT DOCUMENTS

| | | | | |
|---|---|---|---|---|
| D. 346,632 | * | 5/1994 | Castellanos | D21/198 |
| 1,012,802 | | 12/1911 | Brogan . | |
| 1,603,044 | * | 10/1926 | Gise | 224/223 |
| 1,832,633 | * | 11/1931 | Hendrickson | 482/126 |
| 2,408,160 | * | 9/1946 | Brunner | 273/440 |
| 3,069,161 | * | 12/1962 | Melchiona | 482/46 |
| 3,204,955 | | 9/1965 | Quire . | |
| 4,069,954 | * | 1/1978 | Rauch | 224/223 X |
| 4,204,674 | | 5/1980 | Ogland | 272/126 |
| 4,335,875 | | 6/1982 | Elkin | 272/70 |
| 4,973,043 | * | 11/1990 | Nolan | 482/45 |
| 5,498,218 | | 3/1996 | Proctor et al. | 482/10 |
| 5,518,486 | | 5/1999 | Sheeler | 482/131 |
| 5,776,083 | | 7/1998 | Jacob et al. | 601/23 |
| 5,807,218 | | 9/1998 | Nagatomo | 482/124 |

OTHER PUBLICATIONS

AMF Whitely, Physical Fitness Products for 1980, 1980.*
Bollinger Healthcare, Rehabilitation & Support products for physical therapy, 1995–96, p. 18.*

* cited by examiner

*Primary Examiner*—Mickey Yu
*Assistant Examiner*—Denise Pothier
(74) *Attorney, Agent, or Firm*—Ernest D. Buff and Associates; Ernest D. Buff

(57) ABSTRACT

An exercise device comprises a flexible belt having first and second ends; first and second ball shaped handles; and a first and second attaching mechanism attaching each of the ball shaped handles to the first and second ends, respectively. Preferably, the attaching mechanism is operative to rotatably and pivotally attach each of ball shaped handles to first and second ends, respectively. Advantageously, with the the preferred attachment mechanism, each of the handles rotates about a first axis substantially parallel to the length of the belt and the first axis pivots about a second axis parallel to the plane of the belt.

10 Claims, 5 Drawing Sheets

GOLF EXERCISE DEVICE

BACKGROUND OF THE INVENTION

1. Field of the Invention

The present invention relates to exercise devices for stretching, warm-up and rehabilitation of arm, back, leg, neck, shoulder and chest muscles; and more particularly, to a light weight, portable, adjustable exercise device having a flexible belt and rotatable ball shaped handles, for stretching and warm-up activity preceding participation in tennis, golf and other sports.

2. Description of the Prior Art

Various exercise devices are described in the prior art. U.S. Pat. No. 1,012,802 to Brogan, for example, discloses an exercise device that comprises a non-elastic flexible belt approximately the length of the reach of a user's outstretched arms and having movable handles. Furthermore the device has means for shortening the belt. Additionally, the Brogan patent provides for handles that have rotatable gripping members. These gripping members are perpendicular to the length of the belt. Hence, the orientation of the user's hands with respect to the handles is limited while exercising.

U.S. Pat. No. 3,204,955 to Quire et al., discloses an exercise device that comprises an endless, non-elastic, flexible cord and a pair of handles slidably fixed to the cord. The Quire et al. device has means for shortening the distance between the handles, and the handles are provided with holes and recesses for channeling the cord. Like the Brogan device, the orientation of the user's hands with respect to the handles of the Quire et al. device is limited while exercising.

U.S. Pat. No. 4,204,674 to Ogland et al., discloses a pocket-size, adjustable exercise device comprising a freestanding, elongated member hinged along a transverse groove in the middle of the member. A rope-like material is mounted to the end of the elongated member. The Ogland et al. device has handles that are perpendicular the member, thus restricting the positioning of the user's hands during exercise.

U.S. Pat. No. 4,335,875 to Elkins discloses a jogging rope harness comprising a rope member of sufficient and fixed length to extend across the back of a user, looped hand supports, and an elongated cylindrical collar of soft cushioning material. The collar is positionable about the jogger's upper torso and neck to facilitate supporting of said jogger's arms. This device is designed for use by a jogger, and is not appropriately designed for general exercising. The rope loop handles of the Elkins device produce bands of stress on the users hands. In addition, the loop handles limit the orientation of the user's hands while exercising.

U.S. Pat. No. 5,498,218 to Proctor et al., discloses a method for stimulating or increasing the intrinsic range of motion during rotation of the user's neck, as well as relative rotation between adjacent intervertebral joints. The method comprises placing around the back of the neck a strap with gripping means on each end, and the strap having a high friction engagement surface in a central portion positioned to engage against the back of the neck. The Proctor et al. method discloses a strap having resiliency in the central portion thereof. Such resiliency is produced by shape of the strap, wherein the central portion has a generally tubular cross-sectional configuration. This device especially designed for exercising the neck. It is not designed for general exercising. The loop handles of this device produce bands of stress on the users hands, and limit the orientation of the user's hands while exercising.

U.S. Pat. No. 5,518,486 to Sheeler discloses an exercise device that comprises an inelastic, flexible strap having a hand grip at one end and a loop at the other end into which the user's foot is inserted. This device is designed to be gripped with only one hand, and its handle limits the orientation of the user's hands while exercising.

U.S. Pat. No. 5,776,083 to Jacob et al., discloses an exercise device for use in rehabilitative therapy of an impaired limb of a user. The device comprises an elongated shaft having a first end bent into a loop, which is sized and configured to permit the impaired limb of the user to be inserted. A second end of the shaft is bent at an angle substantially perpendicular to the plane defined by the loop so as to form a handle. The impaired limb is within and retained by the loop while an unimpaired limb holds onto the second end to exercise the impaired limb. This device is rigid and highly restricts the orientation of the user's hand.

U.S. Pat. No. 5,807,218 to Nagatomo discloses a device for the relative positioning of human limbs that comprises a flexible strap having a loop at each end. The flexible strap has at least one relatively inelastic length-adjustable portion and at least one elastic portion linearly attached thereto. Each the loops is adapted to be worn on two limbs of a human so as to maintain those two limbs positioned in a specified spaced relation to each other. The Nagatomo device is not designed to be gripped by the hands. It is adapted to be used about the ankles and is limited to non-gripping exercises.

The prior art provides limited means for gripping an exercise device. Exercise modes permitted by prior art devices are severely limited. By restricting the grip position of the user's hands, prior art exercise devices cause unnecessary stress on the wrist and forearm muscles and do not enable the user to gain full range of motion.

SUMMARY OF THE INVENTION

The invention provides an exercise device comprising a flexible belt having first and second ends; first and second ball shaped handles; and first and second attaching means. The attaching means permits the ball shapped handles to be attached to the first and second ends of the belt.

Preferably, the attaching means further comprises means for rotatably and pivotally attaching each of the ball shaped handles to the flexible belt. Each of the handles rotates about a first axis substantially parallel to the length of the belt, and the first axis pivots about a second axis parallel to the plane of the belt. As a result, restrictions on gripping of the handles are minimized. And thus the user is enabled to more fully stretch the muscles.

More specifically, the invention provides for an exercise device comprising: (a) a flexible belt having first and second ends; (b) a first attaching means having a first elongated aperture for receiving said first end, and further having a first cylindrical shaft in the plane of said first elongated aperture, whereby said first attaching means pivots about said first end; (c) a first ball shaped handle having a first cylindrical opening through its center for receiving said first shaft, whereby said first handle rotates about said first shaft; (d) a second attaching means having a second elongated aperture for receiving said second end, and further having a second cylindrical shaft perpendicular to the plane of said second elongated aperture, whereby said first attaching means pivots about said first end; (e) a second ball shaped handle having a second cylindrical opening through its center for receiving said second shaft, whereby said second handle rotates about said second shaft; (f) a first securing means for rotatably securing said first handle to said first cylindrical shaft; and (g) a second securing means for rotatably securing said second handle to said second cylindrical shaft; whereby said handles of said exercise device are adapted to be gripped in a numerous ways which enable substantial variation in exercise regime, maximize stretching of joints and minimize stress on wrists during gripping of said handles.

Advantageously, the exercise device of the present invention has handles which are spherical in shape and in which the axis of rotation is parallel to the length of the belt. In addition, the rotatable handles of the exercise device can pivot with respect to the belt, thereby affording increased gripping opportunity during exercise. Gripping orientations are maximized, and restrictions which can injure the user are minimized. Handle sizes can be readily changed to further minimize injuries caused by restrictions on gripping during exercise. The length of the belt can be adjusted to tailor the distance between the handles for different arm spans and torso lengths of the user. Maximized gripping opportunity permits greater variation in isometric exercise regime and minimizes stress on the user's wrist during exercise.

BRIEF DESCRIPTION OF THE DRAWINGS

The invention will be more fully understood and further advantages will become apparent when reference is had to the following detailed description and the accompanying drawings, in which.

DESCRIPTION OF THE PREFERRED EMBODIMENTS

Figure 1:
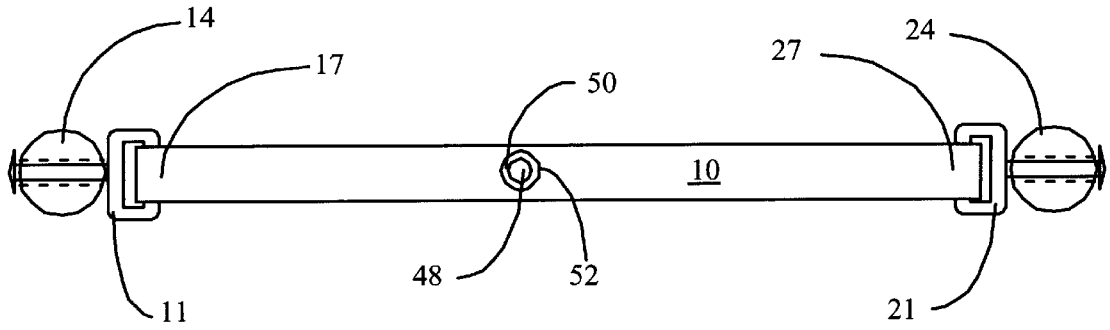
FIG. 1 is a top plan view of an exercise device in accordance with the present invention.
Figure 2:
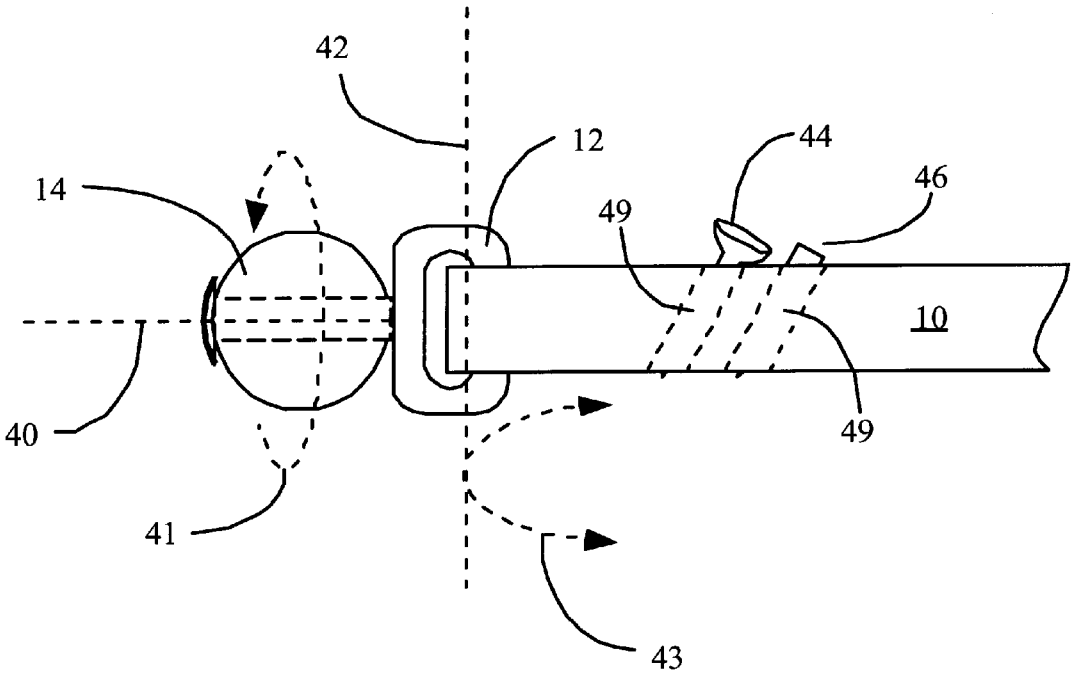
FIG. 2 is a top plan view of a portion of the exercise device shown in FIG. 1, showing means for attaching a ball shaped handle to one end of a flexible belt of the device.

The present invention relates to an exercise device having a flexible belt, and rotatable and pivotable ball shaped handles. Referring to FIGS. 1 and 2, flexible belt 10 has first end 17 and second end 27. Belt 10 preferably has a length ranging from about 20 to about 40 inches. Attaching means 11 attaches first ball shaped handle 14 to first end 17 of belt 10. Attaching means 21 attaches second ball shaped handle 24 to second end 27 of belt 10. In one embodiment of the exercise device, attachment of handles 14, 24 to belt 10 is accomplished by molding at least one, and optionally both, of the handles 14, 24 to ends 17, 27 of belt 10. The first and second handles 14, 24 are preferably comprised of golf balls.

Preferably, the attaching means 11 provides for rotatably and pivotally attaching ball shaped handle 14, and attaching means 21 provides for rotatably and pivotally attaching ball shaped handle 24. First ball shaped handle 14 rotates around first axis 40, while attachment means 11 pivots about belt 10 on second axis 42. First axis 40 is substantially parallel to the length of belt 10, and first axis 40 pivots about second axis 42. Second axis 42 is parallel to the plane of belt 10. In this arrangement, each of the handles rotates with respect to belt 10 as shown by arrow 41, and pivots with respect to belt 10 as shown by arrow 43.

Figure 3:
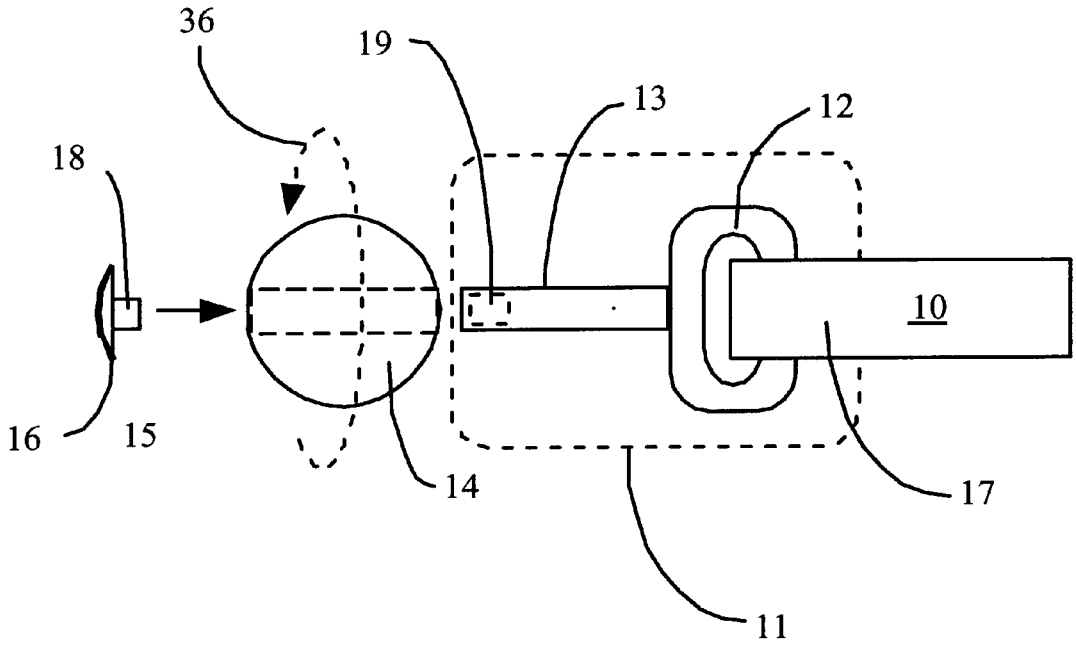
FIG. 3 is an exploded view of the exercise device shown in FIG. 2, further showing the components of the attaching means and the manner for securing the ball shaped handle to one end of the flexible belt.
Figure 4:
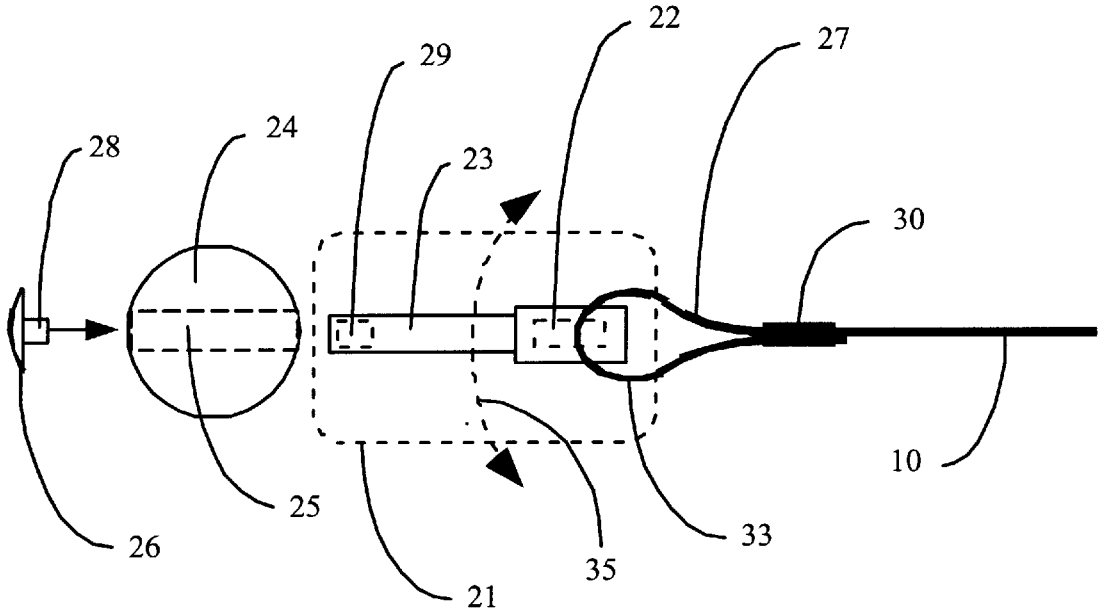
FIG. 4 is an exploded view showing further the components of the attaching means and the manner of attaching them to ball shaped handle to the flexible belt.

Preferably, as shown in FIGS. 3 and 4, first attaching means 11 comprises first elongated aperture 12 for receiving first end 17 of belt 10, and first cylindrical shaft 13 extending in a direction longitudinal of the belt 10 and perpendicular to its width. First ball shaped handle 14 is provided with cylindrical opening 15 for slidably receiving first cylindrical shaft 13. Thereby, first ball shaped handle 14 rotates about first cylindrical shaft 13 as shown by arrow 41 in FIG. 3. First securing means 16 holds first ball shaped handle 14 from sliding off first cylindrical shaft 13.

Similarly, second attaching means 21 comprises second elongated aperture 22 for receiving second end 27 of belt 10, and second cylindrical shaft 23 extending in a direction longitudinal of the belt 10 and perpendicular to its width. Second ball shaped handle 24 is provided with cylindrical opening 15 for slidably receiving second cylindrical shaft 23. Thereby, second ball shaped handle 24 rotates about second cylindrical shaft 23. Second securing means 26 holds second ball shaped handle 24 from sliding off second cylindrical shaft 23.

Figure 5:
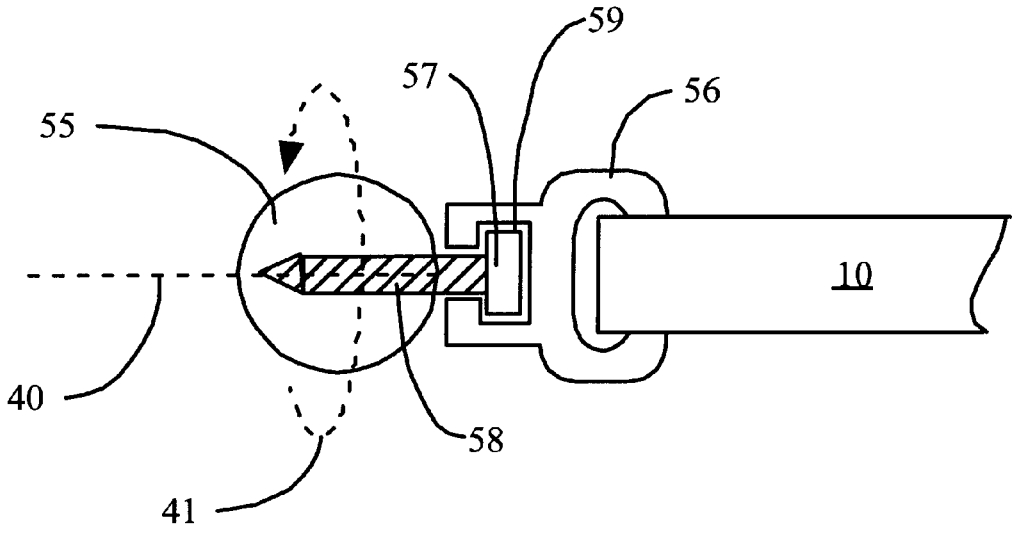
FIG. 5 is a top plan view showing an alternative construction of the attaching means depicted by FIG. 2.

Optionally, first cylindrical shaft 13 is provided with threaded hole 19 for receiving threaded screw 18 of first securing means 16, and second cylindrical shaft 23 is provided with threaded hole 29 for receiving threaded screw 28 of second securing means 26. In this manner, the ball shaped handles can be readily replaced with handles having different sizes and/or shapes. Alternatively, as shown by FIG. 5, the attaching means comprises a threaded screw 32 adapted to penetrate partially into, but not completely through, the handles 24. With this arrangement of the exercise device, the screw is secured to the handle and the clip is rotatably mounted to head 34 of screw 36.

As shown in FIG. 4, second end 27 of belt 10 forms loop 33 through aperture 22. Thereby, second attaching means 21 pivots about second end 27 of belt 10 as shown by arrow 43. Loop 33 is secured by joining means 30. Joining means 30 comprises stitching or alternatively riveting. Similarly, first end 17 is formed into a loop and secured around first aperture 12. Thereby each of the handles both rotates and pivots with respect to belt 10.

Referring to FIG. 2 of the drawings, belt 10 may be provided with a plurality of slots 42, each of which is adapted to receive and hold a golf tee 44 or golf scoring pencil 46. Preferably, each of slots 45 is disposed transversely of said belt at an angle, $\phi$, ranging from about 40 to 60 degrees, whereby tees 44 or pencil 46, when received by slots 45, have little or no discernable portion protruding therefrom.

As shown by FIG. 1, belt 10 may have a central portion in which there is provided an opening 48 having outer edges 52 defined by a grommet 50. In this embodiment of the exercise device, belt 10 can be hung from a golf bag (not shown) by securing grommet 50 to a hook or clip associated therewith.

The present invention provides an exercise device with handles that are adapted to be gripped in a variety of ways, thus enabling substantial variation in exercise regime and minimizing stress on wrists when gripping the handles.

The invention has been described in detail with particular reference to the preferred embodiments thereof, but it will be understood that additional variations and modifications may suggest themselves to one skilled in the art, all falling within the scope of the invention as defined by the subjoined claims.

What is claimed is:

1. An exercise device, comprising:

a) a flexible belt having first and second ends;

b) first and second ball shaped handles; and c) a first and second attaching means for attaching each of said ball shaped handles to said first and second ends, respectively, said first and second attaching means further comprising means for rotatably and pivotally attaching each of said ball shaped handles to said first and second ends, respectively, whereby each of said handles rotates about a first axis substantially parallel to the length of said belt and said first axis pivots about a second axis in the plane of said belt and perpendicular to its length.

2. An exercise device, comprising:

a) a flexible belt having first and second ends;

b) a first attaching means having a first elongated aperture for receiving said first end, a first cylindrical shaft extending in a direction longitudinal of said belt and perpendicular to its width, and pivoting means connecting said first attaching means with said first end, whereby said first attaching means pivots about said first end;

c) a first ball shaped handle having a first cylindrical opening through its center for receiving said first shaft and a rotatable connection with said first attaching means, whereby said first handle rotates about said first shaft;

d) a second attaching means having a second elongated aperture for receiving said second end, a second cylindrical shaft extending in a direction longitudinal of said belt and perpendicular to its width, and pivoting means connecting said second attaching means with said second end, whereby said second attaching means pivots about said second end;

e) a second ball shaped handle having a second cylindrical opening through its center for receiving said second shaft, and a rotatable connection with said second attaching means, whereby said second handle rotates about said second shaft;

f) a first securing means for rotatably securing said first handle to said first cylindrical shaft; and g) a second securing means for rotatably securing said second handle to said second cylindrical shaft;

whereby said handles of said exercise device are adapted to be gripped in a variety of ways which enable substantial variation in exercise regime and minimize stress on wrists during gripping of said handles.

3. A device as recited by claim 2 wherein said belt has a length ranging from about 20 to about 40 inches.

4. A device as recited by claim 2 wherein said first and second handles are comprised of golf balls.

5. A device as recited by claim 2 wherein said first and second securing means are removable, whereby said first and second ball shaped handles are replaceable with handles of another size.

6. A device as recited by claim 2 wherein said belt is provided with a plurality of slots, each of which is adapted to receive and hold a golf tee.

7. A device as recited by claim 6, wherein at least one of said slots is adapted to receive and hold a golf scoring pencil.

8. A device as recited by claim 6, wherein each of said slots is disposed transversely of said belt at an angle ranging from about 40 to 60 degrees, whereby said tees, when received by said slots, have no discernable portion protruding therefrom.

9. A device, as recited by claim 2, wherein said belt has a central portion in which there is provided an opening having outer edges defined by a grommet, whereby said belt can be hung from a golf bag by securing said grommet to a hook or clip associated therewith.

10. An exercise device, comprising:

a) a flexible belt having first and second ends, and being provided with a plurality of slots, each of which is adapted to receive and hold a golf tee, said slots being disposed transversely of said belt at an angle ranging from about 40 to 60 degrees, so that said tees, when received by said slots, have no discernable portion protruding therefrom;

b) a first attaching means having a first elongated aperture for receiving said first end, a first cylindrical shaft extending in a direction longitudinal of said belt and perpendicular to its width, and pivoting means connecting said first attaching means with said first end, whereby said first attaching means pivots about said first end;

c) a first ball shaped handle having a first cylindrical opening through its center for receiving said first shaft and a rotatable connection with said first attaching means, whereby said first handle rotates about said first shaft;

d) a second attaching means having a second elongated aperture for receiving said second end, a second cylindrical shaft extending in a direction longitudinal of said belt and perpendicular to its width, and pivoting means connecting said second attaching means with said second end, whereby said second attaching means pivots about said second end;

e) a second ball shaped handle having a second cylindrical opening through its center for receiving said second shaft, and a rotatable connection with said second attaching means, whereby said second handle rotates about said second shaft;

f) a first securing means for rotatably securing said first handle to said first cylindrical shaft; and g) a second securing means for rotatably securing said second handle to said second cylindrical shaft;

whereby said handles of said exercise device are adapted to be gripped in a variety of ways which enable substantial variation in exercise regime and minimize stress on wrists during gripping of said handles.

* * * * *